US008943961B2

(12) United States Patent
Vella et al.

(10) Patent No.: US 8,943,961 B2
(45) Date of Patent: Feb. 3, 2015

(54) SYSTEMS AND METHODS FOR FACILITATING OIL DELIVERY IN DIGITAL OFFSET LITHOGRAPHIC PRINTING TECHNIQUES

(75) Inventors: Sarah J Vella, Milton (CA); Carolyn Moorlag, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 146 days.

(21) Appl. No.: 13/545,016

(22) Filed: Jul. 10, 2012

(65) Prior Publication Data

US 2014/0013971 A1 Jan. 16, 2014

(51) Int. Cl.

| | |
|---|---|
| ***B41L 11/08*** | (2006.01) |
| ***B41F 1/18*** | (2006.01) |
| ***B41N 3/00*** | (2006.01) |

(52) U.S. Cl.

USPC ..... 101/132.5; 101/375; 101/376; 101/368; 101/450.1; 101/401; 101/453; 101/455

(58) Field of Classification Search

CPC ..... B41N 1/16; B41N 1/22; B41N 1/003; B41F 27/12; B41C 1/1016

USPC ..... 101/453, 455, 375, 376, 368, 132.5, 101/450.1, 401

See application file for complete search history.

(56) References Cited

U.S. PATENT DOCUMENTS

| | | | | |
|---|---|---|---|---|
| 3,800,699 | A | 4/1974 | Carley | |
| 6,085,655 | A * | 7/2000 | Harris et al. | 101/456 |
| 7,191,705 | B2 | 3/2007 | Berg et al. | |
| 2011/0048261 | A1 * | 3/2011 | Shimura | 101/395 |

OTHER PUBLICATIONS

Stowe et al.; U.S. Appl. No. 13/095,714, filed Apr. 27, 2011; "Variable Data Lithography System".

* cited by examiner

*Primary Examiner* — Ren Yan
*Assistant Examiner* — Quang X Nguyen
(74) *Attorney, Agent, or Firm* — Ronald E. Prass, Jr.; Prass LLP

(57) ABSTRACT

A system and method are provided that incorporate a multi-layer plate configuration for a Digital Offset Plate (DOP) including at least a robust top imaging layer and a bottom layer that acts as a reservoir for the releasing oil in a proposed variable digital offset lithographic architecture. The top imaging layer may contain a small amount of oil (<20%) in a range suitable for allowing a small amount of oil to coat the surface and enable release of the ink. A bottom layer may be larger in volume and contain greater quantities (~20-75%) of oil. Oil from the reservoir layer may diffuse to and through the top layer when the oil in the top surface layer is depleted in a manner that maintains a supply of oil at the surface. The top layer may act as a gate to maintain a steady flow of oil to the surface.

12 Claims, 3 Drawing Sheets

SYSTEMS AND METHODS FOR FACILITATING OIL DELIVERY IN DIGITAL OFFSET LITHOGRAPHIC PRINTING TECHNIQUES

BACKGROUND

1. Field of Disclosed Subject Matter

This disclosure relates to systems and methods that incorporate a dual layer plate configuration including at least a robust top imaging layer and a bottom layer that acts as a reservoir for the releasing oil in a proposed variable digital offset lithographic architecture.

2. Related Art

Lithography is a common method of printing or marking images on an image receiving medium. In a typical lithographic process, the surface of a print image carrier, which may be a flat plate, cylinder or belt, is formed to have "image regions" of hydrophobic and oleophilic material, and "non-image regions" of a hydrophilic material. The image regions correspond to the areas on the final print on the image receiving medium that are occupied by a printing or marking material such as ink. The non-image regions are the regions corresponding to the areas on the final print on the image receiving medium that are not occupied by the printing or marking material. The hydrophilic regions accept, and are readily wetted by, a water-based dampening fluid, which is commonly referred to, and will be generally referred to in this disclosure, as a "fountain solution." The fountain solution typically consists of water and a small amount of alcohol, and may include other additives and/or surfactants that facilitate non-adherence of ink in those regions. The deposition of fountain solution over the hydrophilic regions forms a fluid "blocking layer" for rejecting ink. Therefore, the hydrophilic regions of the printing plate correspond to unprinted areas, or "non-image areas", of the final print on the image receiving medium. The hydrophobic regions repel the fountain solution and accept the ink.

Depending on a configuration of a conventional lithography system, the ink may be transferred directly to a substrate of image receiving media, such as paper, or may be applied to an intermediate surface, such as an "offset" (or blanket) cylinder. This latter configuration is referred to as an offset lithographic printing system. The offset or blanket cylinder is covered with a conformable coating or sleeve with a surface that can conform to the texture of the image receiving medium substrate, which may have surface peak-to-valley depth somewhat greater than the surface peak-to-valley depth of the imaging plate. Sufficient pressure is used to transfer the image from an imaging member or from the offset or blanket cylinder to the substrate. The substrate of image receiving media is pinched between the imaging member or the offset or blanket cylinder and an impression cylinder that provides pressure against the imaging member or the offset or blanket cylinder to provide an imaging nip through which the substrate of image receiving media passes to have the image printed or marked thereon.

Conventional lithographic and offset lithographic printing techniques use plates that are permanently patterned, and are, therefore, generally considered to be useful only when printing a large number of copies of the same image in long print runs, such as for magazines, newspapers, and the like. These conventional processes are generally not considered amenable to creating and printing a new pattern from one page to the next because, according to known methods, removing and replacing of plates, including on a print cylinder, would be required in order to change images. For these reasons, conventional lithographic techniques cannot accommodate true high speed variable data printing processes in which the images to be printed change from impression to impression, for example, as in the case of digital printing systems. Additionally, the cost of the permanently-patterned imaging plates or cylinders is amortized over the number of copies of a document that are produced. The cost per printed copy is, therefore, higher for shorter print runs of the same image than for longer print runs of the same image, as opposed to prints from variable data digital printing systems.

The lithography process provides very high quality printing at least in part due to the quality and color gamut of the inks used. The inks, which typically have a very high color pigment content, typically in a range of 20-70% by weight, are very low cost compared to toners and many other types of printing or marking materials. This comparatively low cost generates a desire to use the lithographic and offset inks for printing or marking in order to take advantage of the high quality and low cost in a manageable manner if a system can be made manageable to printing variable image data from page to page. Previously, the number of hurdles to providing variable data printing using lithographic inks appeared insurmountable. Even the desire to reduce a cost per copy for shorter print runs of the same image presented challenges. Ideally, the desire is to incur the same low cost per copy of a long offset or lithographic print run, e.g., of more than 100,000 copies, for a medium print run, e.g., on the order of 10,000 copies, and for a short print run, e.g., on the order of 1,000 copies. Full implementation of a variable printing scheme using lithographic inks may ultimately result in the economies reaching the single copy print run in a true variable data printing system or method.

Efforts have been made to create lithographic and offset lithographic printing systems for variable data in the past. One example is disclosed in U.S. Pat. No. 3,800,699 in which an intense energy source such as a laser is used to pattern-wise evaporate a dampening fluid. In another example disclosed in U.S. Pat. No. 7,191,705, a hydrophilic coating is applied to an imaging belt. A laser selectively heats and evaporates or decomposes regions of the hydrophilic coating. A water-based fountain solution is then applied to these hydrophilic regions, rendering them oleophobic. Ink is then applied and selectively transferred onto the plate only in the areas not covered by fountain solution, creating an inked pattern that can be transferred to a substrate of image receiving media. Once transferred, the imaging belt is cleaned, a new hydrophilic coating and fountain solution are deposited, and the patterning, inking, and printing steps are repeated, for example, for printing the next batch of images.

In yet another example, a rewritable surface is used that can switch from hydrophilic to hydrophobic states without application of thermal, electrical or optical energy. Examples of these surfaces include the so-called switchable polymers and metal oxides such as $ZnO_2$ and $TiO_2$. After changing the surface state, fountain solution selectively wets the hydrophilic areas of the programmable surface and, therefore, causes a rejection of the application of ink to these areas. These switchable coatings, particularly the switchable polymers, tend to be expensive to coat onto a surface and are typically prone to excessive wear. Also, these switchable coatings tend not to have the capacity to transform between hydrophobic and hydrophilic states in the sub-millisecond time range that would be required to enable high-speed variable data printing using lithographic techniques. Based on this, the effectiveness of using switchable coatings may be in limited short-run print projects rather than being adaptable to truly variable data high-speed digital lithography in which every impression can have a different image pattern changing from one print cycle to the next.

The above-described attempts at implementing variable data lithographic printing still suffered from numerous difficulties. For example, most imaging plate or belt surfaces using lithographic printing have a micro-roughened surface structure to retain fountain solution in the non-imaging areas. The micro-roughened surface aids in retaining the liquid fountain solution, enhancing an affinity toward the fountain solution so that the liquid does not get forced away from the surface by, for example, action at a roller nip. Shearing forces in the nip between the imaging surface and the ink forming roller can overwhelm any static or dynamic surface energy forces drawing fountain solution to the surface.

A difficulty arises, however, in that these micro-roughened surfaces are difficult to clean by conventional mechanical means such as, for example, by using knife-edge cleaning systems for scraping residual ink from the plate or belt surface. The knife simply cannot get into the pits in the micro-roughened surface, which is there to effectively retain the fountain solution. Additionally, physical contact between the knife and the plate or belt surface results in significant wear. Once the surface is worn, there is a relatively high cost of replacing a plate or belt. Non-contact cleaning processes, such as high-pressure rinsing or solvent cleaning are possible. These cleaning processes, however, tend to increase costs significantly, not only based on the inclusion of required additional subsystems, but also on a potential cost associated with hazardous waste disposal. Further, to date, these non-contact cleaning processes are of unproven effectiveness.

In an effort to improve cleaning on each pass, with an objective of providing ghost-free printing, the prior art systems describe using a very smooth belt or plate surface. See, e.g., U.S. Pat. No. 7,191,705 referenced above. Known techniques for cleaning the surface are more effective on these smooth surfaces. Physical scraping still has an effect of wearing the physical surface, but it is lessened. The difficulty with using smooth surfaces is that the advantage in being able to clean the smooth surface is offset with the reduced ability to retain a hydrophilic coating and printing or marking material as compared to the micro-roughened surface. So surfaces, therefore, may necessitate employing additional and costly subsystems such as, for example, surface energy conditioning subsystems including a corona discharge apparatus, which themselves can induce wear or damage to the plate or belt surface. Precise metering of the fountain solution additionally can become more difficult without the presence of correct texture such as, for example, with the micro-roughened surface. Also, spreading or other lateral movement of the fountain solution on a texture-free surface may compromise ultimate imaging resolution.

Another disadvantage encountered in attempting to modify conventional lithographic systems for variable printing is a relatively low transfer efficiency of the inks off of the imaging plate or belt. Common conventional lithographic and offset printing or marking processes operate with ink transfer ratios on the order of approximately 50-50, i.e., about half of the ink that is applied to the "reimageable" surface actually transfers to the image receiving media substrate requiring that the other half of the ink be cleaned off the surface of the plate or belt and removed. This relatively low efficiency compounds the cleaning problem in that a significant amount of cleaning is required to completely wipe the surface of the plate or belt clean of ink so as to avoid ghosting of one image onto another in variable data printing using a modification of conventional lithographic techniques. Also, unless the ink can be recycled without contamination, the effective cost of the ink is doubled. Traditionally, however, it is very difficult to recycle the highly viscous ink, thereby increasing the effective cost of printing and adding costs associated with ink disposal. Proposed systems fall short in providing sufficiently high transfer ratios to reduce ink waste and the associated costs. A balance must therefore be struck in the composition of the ink to provide optimum spreading on a plate or belt surface including adequate separation between printing and non-printing areas, increased ability to transfer to a substrate, and an ability to clean the ink in a manner that produces less wear on the plate or belt.

SUMMARY OF THE DISCLOSED EMBODIMENTS

In order to address the above-identified shortfalls, U.S. patent application Ser. No. 13/095,714 (the 714 Application), which is commonly assigned and the disclosure of which is incorporated by reference herein in its entirety, proposes systems and methods for providing variable data lithographic and offset lithographic printing or image receiving medium marking. The systems and methods disclosed in the 714 Application are directed to improvements on various aspects of previously-attempted variable data imaging lithographic marking concepts based on variable patterning of fountain solutions to achieve effective truly variable digital data lithographic printing.

According to the 714 Application, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 714 Application describes, in requisite detail, an exemplary variable data lithography system 100 such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 Application.

As shown in FIG. 1, the exemplary system 100 may include an imaging member 110. The imaging member 110 in the embodiment shown in FIG. 1 is a drum, but this exemplary depiction should not be read in a manner that precludes the imaging member 110 being a plate or a belt, or of another known configuration. The imaging member 110 is used to apply an ink image to an image receiving media substrate 114 at a nip 112. The nip 112 is produced by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 Application also explains the wide latitude of marking (printing) materials that may be used, including marking materials with pigment densities greater than 10% by weight. As does the 714 Application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a fountain solution subsystem 120 generally comprising a series of rollers, which may be considered as dampening rollers or a dampening unit, for uniformly wetting the reimageable surface of the imaging member 110 with fountain solution. A purpose of the fountain solution subsystem 120 is to deliver a layer of fountain solution, generally having a uniform and controlled thickness, to the reimageable surface of the imaging member 110. As indicated above, it is known that the fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well.

Once the fountain solution is metered onto the reimageable surface of the imaging member 110, a thickness of the fountain solution may be measured using a sensor 125 that may provide feedback to control the metering of the fountain solution onto the reimageable surface of the imaging member 110 by the fountain solution subsystem 120.

Once a precise and uniform amount of fountain solution is provided by the fountain solution subsystem 120 on the reimageable surface of the imaging member 110, and optical patterning subsystem 130 may be used to selectively form a latent image in the uniform fountain solution layer by imagewise patterning the fountain solution layer using, for example, laser energy. The reimageable surface of the imaging member 110 should ideally absorb most of the laser energy emitted from the optical patterning subsystem 130 close to the surface to minimize energy wasted in heating the fountain solution and to minimize lateral spreading of heat in order to maintain a high spatial resolution capability. Alternatively, an appropriate radiation sensitive component may be added to the fountain solution to aid in the absorption of the incident radiant laser energy. While the optical patterning subsystem 130 is described above as being a laser emitter, it should be understood that a variety of different systems may be used to deliver the optical energy to pattern the fountain solution.

The mechanics at work in the patterning process undertaken by the optical patterning subsystem 130 of the exemplary system 100 are described in detail with reference to FIG. 5 in the 714 Application. Briefly, the application of optical patterning energy from the optical patterning subsystem 130 results in selective evaporation of portions of the layer of fountain solution.

Following patterning of the fountain solution layer by the optical patterning subsystem 130, the patterned layer over the reimageable surface of the imaging member 110 is presented to an inker subsystem 140. The inker subsystem 140 is used to apply a uniform layer of ink over the layer of fountain solution and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink deposited on the unformatted portions of the fountain solution will not adhere based on the hydrophobic and/or oleophobic nature of those portions.

A cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the nip 112 may allow transfer efficiencies for the ink from the reimageable surface of the imaging member 110 to the substrate 114 to exceed 95%. While it is possible that some fountain solution may also wet substrate 114, the volume of such a fountain solution will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual fountain solution must be removed from the reimageable surface of the imaging member 110, preferably without scraping or wearing that surface. An air knife 175 may be employed to remove residual fountain solution. It is anticipated, however, that some amount of ink residue may remain. Removal of such remaining ink residue may be accomplished through use of some form of cleaning subsystem 170. The 714 Application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the fountain solution of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 Application details other mechanisms by which cleaning of the reimageable surface of the imaging member 110 may be facilitated. Regardless of the cleaning mechanism, however, cleaning of the residual ink and fountain solution from the reimageable surface of the imaging member 110 is essential to preventing ghosting in the proposed system. Once cleaned, the reimageable surface of the imaging member 110 is again presented to the fountain solution subsystem 120 by which a fresh layer of fountain solution is supplied to the reimageable surface of the imaging member 110, and the process is repeated.

According to the above proposed structure, variable data digital lithography has attracted attention in producing truly variable digital images in a lithographic image forming system. The above-described architecture combines the functions of the imaging plate and potentially a transfer blanket into a single imaging member 110.

Plates designed for the above-described variable digital data lithographic printing architecture may preferably satisfy a range of requirements including wetting and pinning the fountain solution, absorbing optical radiation from the optical patterning subsystem, wetting and pinning the ink, and releasing the ink to yield a relatively clean plate (the objective indicated above being in excess of 95% transfer to the substrate surface).

Releasing the ink is a challenging step and few materials sets achieve what can be considered good ink release, especially given an absence of an applied releasing fluid. Silicone elastomers containing a portion (approximately 10-20%) of uncrosslinked PDMS demonstrated reasonable release of ink in preliminary print tests. Ink release may be considered to be dependent on continued delivery of a releasing oil in the plate to the plate surface. That oil supply diminishes over time and during high speed printing. The estimated lifetime of the current configuration of a plate system (PDMS plate with dispersed silicone oil) proposed for the variable digital data lithographic printing system is limited, such as, for example, to as few as 60 prints. Two factors contribute to this limited estimated lifetime: (1) the low robustness of the plate itself, and (2) the limited supply of silicone oil embedded in the plate as a releasing agent. These two factors are considered tradeoffs between one another. The factors are in tension with one another in that an increase the robustness (strength) of the plate, may require a decrease in the content of free silicone oil. This decrease in the amount of silicone oil decreases an availability of the necessary supply of releasing agent to facilitate ink transfer. Put simply, what is needed, and provided by embodiments of this disclosure is an agent that releases and an agent that "further" releases over time.

In view of the above constraints, it would be advantageous to provide a configuration for a plate surface on an imaging member in the variable digital data lithographic architecture that combines enhanced storage of releasing material with enhanced robustness for long-life.

Exemplary embodiments may provide a multi-layer plate configuration. In an exemplary embodiment, a proposed dual-layer plate configuration may include a robust top layer and a bottom layer that may act as a reservoir for the releasing oil. The top layer may contain a small amount of oil (<20%) in a range that is suitable for allowing a small amount of oil to coat the surface and enable release of the ink. The top layer may be semi-permeable. The second or bottom layer under the top layer may act as an oil reservoir, which may be larger in volume and contain greater quantities (~20-75%) of oil than the top layer. Oil from the second (reservoir) layer may diffuse to and through the semi-permeable top layer when the oil in the top layer is depleted in a manner that maintains a supply of oil at the surface. The top layer may act as a gate to maintain a steady flow of oil to the surface. The exemplary dual-layer plate strategy may satisfy both requirements for robustness and a sufficiency in a supply of releasing oil.

Exemplary embodiments may provide a plate that performs multiple functions, including (1) wetting of fountain solution, (2) pinning of fountain solution, (3) efficient thermal absorption of light to evaporate fountain solution, (4) wetting of ink, and (5) complete or near-complete transfer of ink to a substrate of image receiving media. The multi-layer plate structure may be carefully and optimally designed to achieve these functions.

Exemplary embodiments may provide a mechanism of oil supply to the surface enabled by compression of the multi-layer plate during transfer to a substrate of image receiving media, which would squeeze oil from the reservoir layer to the top layer, and then to the plate surface. In this manner, the printing action may aid in bringing oil to the surface to interface with the ink, and replenish ink in the top layer.

In exemplary embodiments, the multi-layer architecture may exhibit certain preferable characteristics. The top layer may exhibit measured permeability to properly regulate a diffusion of the releasing material therethrough. There should preferably be an appropriate level of adhesion between the layers. The releasing material should be compatible with the materials of the top layer and the second (reservoir) layer in order that it may be compatibly hosted by both layers.

Exemplary embodiments may provide a composition of materials used in a dual-layer plate configuration that includes a polymeric matrix and a releasing oil. The polymeric matrix may be an elastomer such as silicone (polydimethylsiloxane PDMS), fluorosilicone, or FKM fluoroelastomer (Viton®, Dyneon® or the like). The releasing oil may be PDMS silicone oil, functionalized silicone oil, fluorosilicone oil, or other releasing oils. Crosslinkers, dispersants, and other additives may be included. The following compounds are examples of compounds that may act as release agents: (1) Trifluoropropylmethylcyclotrisiloxane (D3F); (2) Trifluoropropylmethylcyclotetrasiloxane (D4F); and (3) Decamethylcyclopentasiloxane (D5). These are but examples of the many compounds that may be used.

Exemplary embodiments may provide a unique design including at least the following (1) A materials composition for a digital offset printing plate containing: (a) a polymeric matrix, and (b) a releasing oil; (2) A multi-layer design that satisfies both specified levels of robustness and sufficient supply of releasing oil; (3) A multi-layer plate that functions as both a reservoir and gate of the releasing material dispersed in the polymeric matrix; (4) A capacity to disperse silicone oil in cross-linked PDMS in fractions as high as 0.75; (5) A thickness and porosity of the upper layer that may be varied to control the amount of releasing material delivered to the surface of the plate; and (6) Sufficient wetting of the plate with the ink and fountain solutions, and improved release of the ink.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods that incorporate a multi-layer plate configuration including at least a robust top imaging layer and a bottom layer that acts as a reservoir for the releasing oil in a proposed digital marking method for using variable digital offset lithographic architecture will be described, in detail, with reference to the following drawings, in which.

DETAILED DESCRIPTION OF THE DISCLOSED EMBODIMENTS

The systems and methods that incorporate a multi-layer plate configuration including at least a robust top imaging layer and a bottom layer that acts as a reservoir for the releasing oil in a proposed digital marking method for using variable digital offset lithographic architecture will generally refer to this specific utility or function for those systems and methods. Exemplary embodiments described and depicted in this disclosure should not be interpreted as being specifically limited to any particular configuration of the described elements, or as being specifically directed to any particular intended use. Any advantageous combination of multiple layers that include at least one robust imaging layer and at least one oil reservoir layer to promote oil supply/resupply to an imaging surface over one or more structural layers in a variable data lithographic printing system that facilitate high quality output lithographic images are contemplated as being included in this disclosure.

Specific reference to, for example, lithographic printing techniques, and to a proposed variable data lithographic printing device should not be considered as being limited to any particular configuration of the techniques or devices, as described. The terms "image forming device," "offset lithographic printing device/system," "offset lithographic marking device/system" and the like, as referenced throughout this disclosure are intended to refer globally to a class of devices and systems that carry out what are generally understood as lithographic marking functions as those functions would be familiar to those of skill in the art. Additionally, while references will be made to individual exemplary releasing oils, agents and the like, these references too are intended to be exemplary.

Figure 1:
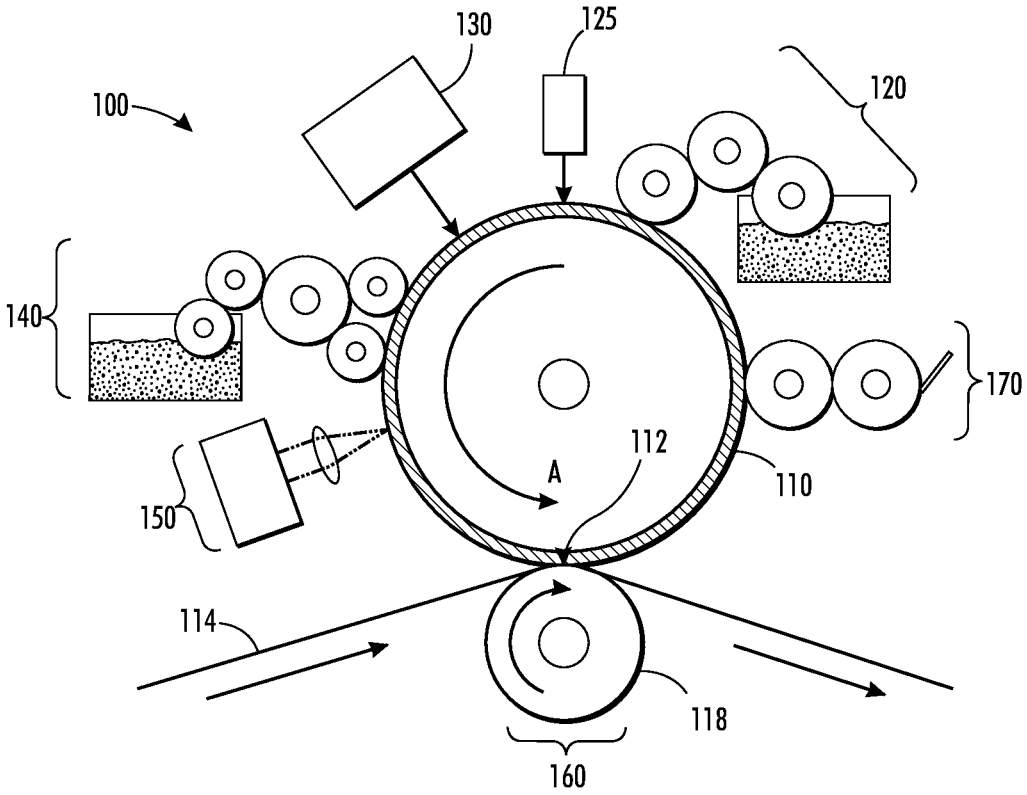
FIG. 1 RELATED ART
FIG. 1 illustrates a schematic representation of a proposed variable data lithographic printing system.
Figure 2A:
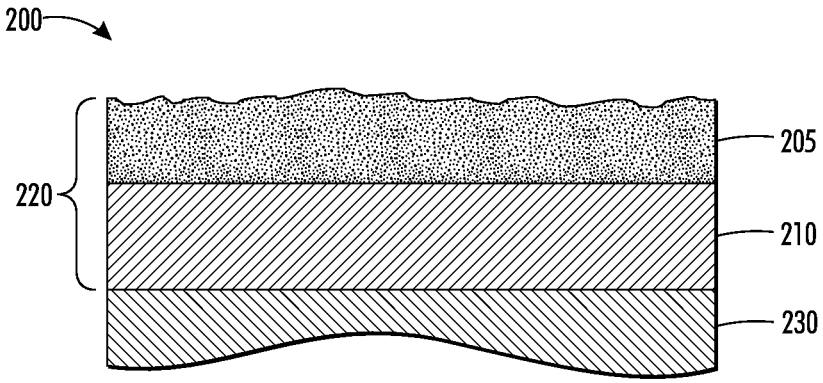
FIGS. 2A and 2B illustrate schematic representations of exemplary embodiments for an imaging member structure in the proposed variable data lithographic printing system of FIG. 1.
Figure 2B:
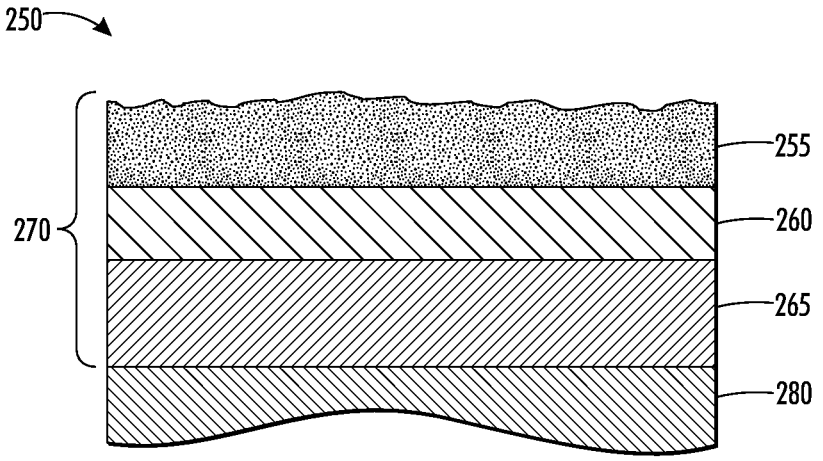

FIGS. 2A and 2B illustrate schematic representations of exemplary embodiments 200/250 for an imaging member structure in the proposed variable data lithographic printing system of FIG. 1. The 714 application describes similar depictions as including a portion of imaging member shown in cross-section.

FIG. 2A illustrates an exemplary imaging member structure 200 including a single thin reimageable surface layer 205 formed over a structural mounting layer 210 that may be formed of, for example, metal, ceramic, plastic or like materials, which together form a reimaging portion 220. Reimaging portion 220 may take the form of a stand-alone drum or web, or may be wrapped around an additional cylinder core 230.

FIG. 2B illustrates another exemplary imaging member structure 250 including a single thin reimageable surface layer 255 over a multi-level structural member 260/265 to collectively form reimaging portion 270. In this exemplary embodiment, reimaging portion 270 may include additional structural layers, such as intermediate layer 260 below the reimageable surface layer 255 and above the structural mounting layer 265 as shown. Alternatively, the additional intermediate structural layer may be positioned below the structural mounting layer 265. The intermediate layer 260 may be, for example, electrically insulating or conducting and/or thermally insulating or conducting, and/or may have variable compressibility and durometer, and/or exhibit other like characteristics.

The structural layers disclosed in the 714 Application support the single thin top surface layer 205/255 that is configured in a manner that is intended to optimize roughness and surface energy properties. In embodiments, the reimageable portion 220/270 may be a continuous elastic sleeve placed over a cylinder core 230/280. Flat plate, belt, and web arrangements (which may or may not be supported by an underlying structure, such as a drum configuration structure) are also contemplated.

Regardless of a specific configuration of the underlying structure, the 714 Application proposes that the single thin reimageable surface layer 205/255 may consist of a polymer, such as PDMS, for example, with a wear resistant filler material such as silica to help strengthen the silicone and optimize its durometer, and may contain catalyst particles that help to cure and cross link the silicone material. The single thin reimageable surface layer 205/255 may optionally contain a small percentage of radiation sensitive particulate material dispersed in the layer that can absorb optical (laser) energy highly efficiently.

Alternatively, the single thin reimageable surface layer 205/255 may be tinted or otherwise treated to be uniformly radiation sensitive. Still further, single thin reimageable surface layer 205/255 may be essentially transparent to optical energy from a source, and the structural mounting layer(s) 210/260/265 may be absorptive of the optical energy.

It is generally understood that single thin reimageable surface layer 205/255 should have a weak adhesion force to the ink at the interface with good oleophilic wetting properties for the ink, to promote uniform (free of pinholes, beads or other defects) inking of the reimageable surface and to promote the subsequent forward transfer lift off of the ink onto the substrate of image receiving media.

As discussed above, the single top reimageable surface layer 250/255 facilitates ink release based on its composition including a content of free silicone oil, which is depleted over time, a limited amount of time, i.e., cycles of operations. A multi-layer structure for a reimageable layer is proposed that addresses this oil depletion and thereby facilitates longer life of the reimageable layer while maintaining adequate ink transfer efficiency.

Figure 3:
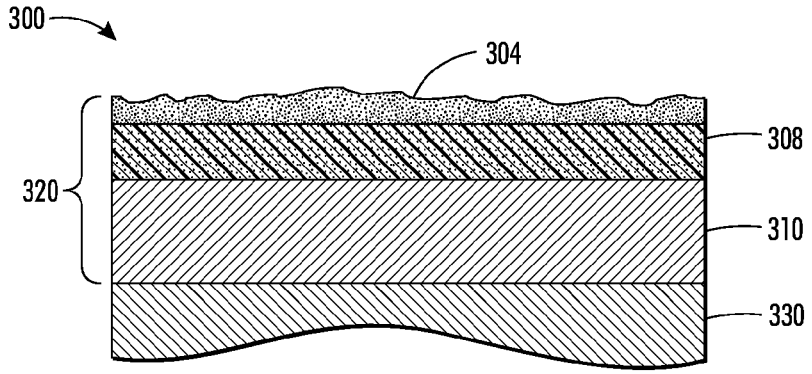
FIG. 3 illustrates a schematic representation of a first exemplary embodiment of a modified imaging surface structure for a proposed variable data lithographic printing system according to this disclosure.

FIG. 3 illustrates a schematic representation of an exemplary embodiment of a modified imaging member structure 300 for a proposed variable data lithographic printing system according to this disclosure. As shown in FIG. 3, a specific modification is proposed to the imaging member structures 200/250 shown in FIGS. 2A and 2B. To the extent possible, a similar numbering scheme is used where applicable for certain of the common elements shown in FIGS. 2A and 3 in order to highlight those elements that are generally common between the structure shown in FIG. 2A and the exemplary structure 300 shown in FIG. 3.

According to the exemplary embodiment shown in FIG. 3, the reimageable surface layer may comprise a plurality of layers that may combine to promote extended high ink transfer efficiency, i.e., greater than 95%, for the transfer of the images from the reimageable surface layer to a substrate of image receiving media. FIG. 3 depicts a two layer configuration including a top layer 304 and a second layer 308, the second layer 308 acting as a reservoir for the releasing agent/oil. The top layer 304 may contain a small amount of releasing agent/oil (<20%) in a range that is suitable for allowing a small amount of oil to coat the surface of the top layer 304 and enable release of the ink. The second layer 308 under the top layer 304, acting as the oil reservoir, may be larger in volume and may contain greater quantities (~20-75%) of releasing agent/oil than the top layer 304. Releasing agent/oil from the second (reservoir) layer 308 may diffuse to and through the top layer 304, which may be semi-permeable, when releasing agent/oil in the top layer 304 is initially depleted to maintain a supply of the releasing agent/oil at the surface. The top layer 304 may, therefore, act as a gate to maintain a steady flow of releasing agent/oil to the imaging surface.

The depicted dual layer plate configuration may be both robust and sufficient in supplying releasing agent/oil for extending the usable life of the imaging surface. This configuration may enable extended delivery of releasing agents/oils to the surface at the top layer 304. The second (reservoir) layer 308 may be capable of continually delivering releasing agent/oil to the top layer 304. In this manner, a steady stream of releasing agent/oil may be supplied to the surface in just enough quantity to enable ink release, while not too much to prevent the ink from wetting. In other words, a controlled gradient for the releasing agent/oil may be generated/managed based on the specifics of the structure.

The mechanism of ink supply to the surface of the top layer 304 may be enabled by compression of the dual layer structure during transfer of an image to the substrate of image receiving media at the transfer nip. See FIG. 1. The interaction of an impression roller 118, as part of an image transfer mechanism, exerting pressure in the direction of an imaging member (see FIG. 1) may squeeze releasing agent/oil from the second (reservoir) layer 308 to the top layer 304, and the imaging surface. In a system such as that shown in FIG. 1 with a dual layer imaging surface system such as that shown in FIG. 3 in which the reimageable portion 320 may be placed over a cylinder core 330, structural member 310 may provide a solid layer that the dual layer structure is pressed against by the printing action to aid in bringing releasing agent/oil to the surface to interface with the ink, and replenish releasing agent/oil in the top layer 304.

Although each of the layers 304/308 shown in FIG. 3 is depicted as a single layer, either of the top layer 304 or the second layer 308 may include more than one layer of material cooperating to provide robustness in the case of the top layer 304 or the releasing agent/oil supply reservoir capacity of second layer 308. Separately, the top layer 304 may include, or be overlaid with, an infrared absorbing agent in the top layer 304 or in an overlying layer. A multiple layer reservoir layer may be appropriately configured in a manner that further controls diffusing of the releasing agent/oil.

The composition of the materials used in the dual layer configuration may include a polymeric matrix and a releasing agent/oil. The polymeric matrix may be an elastomer such as silicone (polydimethylsiloxane PDMS), fluorosilicone or FKM fluoroelastomer (including Viton®, Dyneon® or the like). The releasing agent/oil may be PDMS silicone oil, functionalized silicone oil, fluorosilicone oil, or other releasing agents/oils. Crosslinkers, dispersants, and other additives may be included. The following compounds are examples of compounds that may also act as release agents: (1) Trifluoropropylmethylcyclotrisiloxane (D3F); (2) Trifluoropropylmethylcyclotetrasiloxane (D4F); and (3) Decamethylcyclopentasiloxane (D5). These are but examples of the many compounds that may be used.

Cross-linked PDMS may be made using a known two component system, the two components being a base and a curing agent generally mixed in a 10 to 1 ratio, respectively. Varying the ratio of the two components is known to change mechanical properties of the final cross-linked polymer.

In experiments, single layer and double layer PDMS disks were fabricated. Single layer disks were fabricated using either PDMS only, or silicone oil dispersed in the cross-linked PDMS matrix. The double layer PDMS samples were fabricated in two steps; the bottom layer was prepared and cured first, then the top layer was cured on top of the bottom layer. The bottom layer consisted of the PDMS:silicone oil mixtures with compositions of either 1:1 or 1:2; the top layer consisted of PDMS only.

Three double layer disks with the top layers consisting of only PDMS were fabricated with varying ratios of base to curing agent in proportions of: (a) 25:1; (b) 20:1; and (c) 15:1. In all of these disks, the bottom layer was composed of PDMS (10:1):Silicone Oil 1:2. The disks were fabricated so that the final thickness of both the single and double layer disks was approximately 2.5 mm. To demonstrate that the amount of oil that is released from the layers of a double layer disk is different from the amount of oil that is released from a single layer disk, each disk was placed between two circular pieces of paper and an equivalent amount of force was applied to each sample. The results indicated that an approximately equivalent amount of oil absorbed onto the top and bottom papers for the single layer disk, and that less oil absorbed onto the top paper than the bottom paper for the double layer disks. The amount of oil absorbed on the bottom papers was similar in all samples. The amount of oil absorbed on the top paper from the double layer disks was also similar between the three samples indicating that the crosslinking density did not have a significant effect on the release of the oil from the bottom layer. It is important to note that although the top layer of the double layer disks did not originally contain any silicone oil, silicone oil was still absorbed onto the top piece of paper. This observation indicates that the oil from the reservoir does penetrate through the top layer to be delivered to the surface to act as a releasing agent.

Also, the ability of the PDMS disks (single and double layer disks) to function as a viable lithographic imaging plate was compared by first applying a "blocking solution" and then inking the disk with a cyan ink formulation. The ink formulation was then transferred to a piece of paper by pressing the paper to the disk and using a roller to provide sufficient pressure for ink transfer. The transfer process was carried out three times per disk. Ideally, all ink should transfer the first time, although optimization was still considered appropriate to attain highest transfer efficiencies. Observed/tested samples were considered to "pass" the transfer test embodied in this experimental undertaking if, by the third transfer, no ink remained on the observed/tested plate.

Three disks used were: (a) Double Layer—Top layer: PDMS (30:1); Bottom layer: PDMS (10:1):silicone oil 1:1; (b) Single Layer—PDMS (30:1); and (c) Single Layer—PDMS (10:1):silicone oil 1:1. The top side of each disk was inked and the ink transfer characteristics compared. The double layer disk was shown to have similar ink transfer characteristics to the single layer PDMS:silicone oil composite disk. It appeared that most of the ink using these two samples had transferred from the disk to the paper by the third transfer. In contrast, the ink had not completely transferred to the paper when the single layer disk fabricated from PDMS only was used. These results indicate that the PDMS-only disk did not contain sufficient quantity of free silicone oil to enable the transfer of ink to paper. The double-layer disk did enable the transfer of ink to the paper indicating that sufficient quantity of silicone oil was released from the bottom reservoir layer.

The above experiments confirmed that the multi-layer design could be employed to optimize the robustness of the top surface, while significantly increasing a releasing agent/oil rewetting capacity in support of highest levels of ink transfer efficiency from an imaging surface of a variable digital data lithography imaging member to a substrate of image receiving media.

Again here, it should be noted that neither of a top layer or a second (reservoir) layer in the disclosed structure is limited to a "single" layer.

Figure 4:
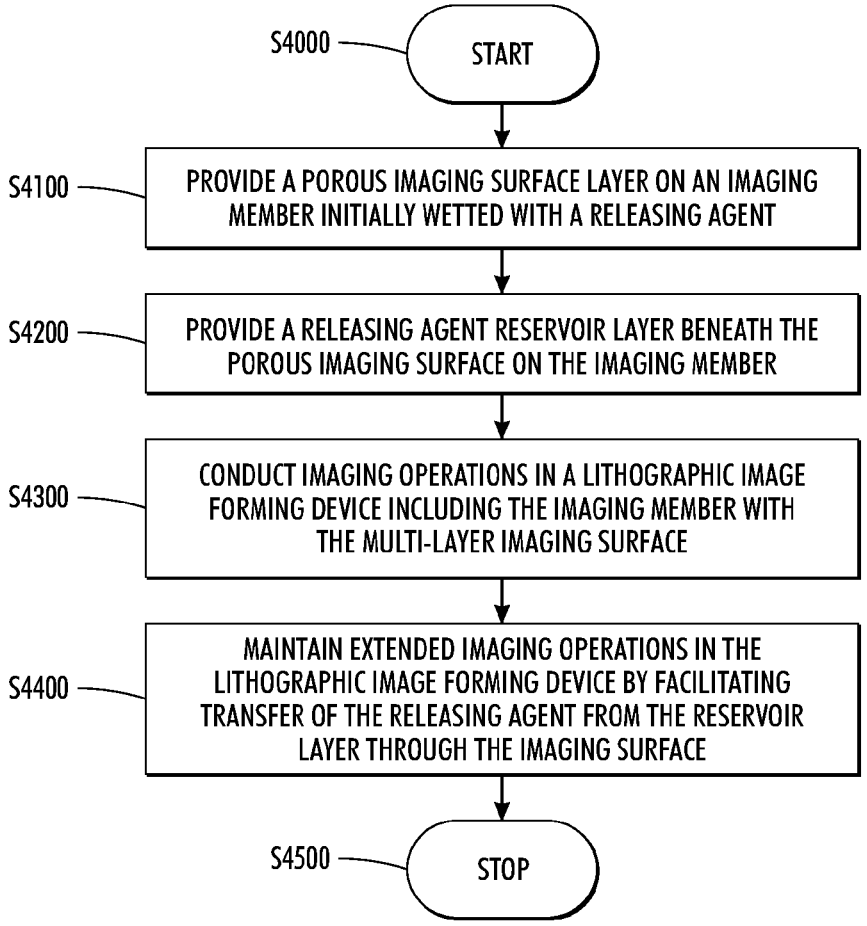
FIG. 4 illustrates a flowchart of an exemplary method for implementing variable data lithographic printing using a uniquely modified imaging surface structure for a proposed variable data lithographic printing system according to this disclosure.

The disclosed embodiments may include methods that incorporate a dual-layer configuration including at least a robust top imaging layer and a bottom layer that acts as a reservoir for the releasing oil in a proposed digital marking method for using a variable digital data lithographic architecture for implementing variable data lithographic printing. FIG. 4 illustrates a flowchart of such an exemplary method. As shown in FIG. 4, operation of the method commences at Step S4000 and proceeds to Step S4100.

In Step S4100, a semi-permeable imaging surface layer may be provided on an imaging member. The imaging surface layer may be wetted with a releasing agent/oil. The releasing agent/oil may be included to support a highest rate of ink transfer efficiency from the imaging surface layer to a substrate of image receiving media. Operation of the method proceeds to Step S4200.

In Step S4200, a releasing agent reservoir layer may be provided below the image surface layer on the structure of the imaging roller such as, for example, on a structural layer, or on a cylinder core. The releasing agent reservoir layer may be loaded with additional releasing agent to replenish the releasing agent on the surface of the imaging surface layer to facilitate highly efficient ink transfer from the imaging member over a greater number of individual image forming operations. Operation of the method proceeds to Step S4300.

In Step S4300, imaging operations in a lithographic image forming device are conducted using the imaging member with the multi-layer structure including a top imaging layer and the releasing agent reservoir layer. Operation of the method proceeds to Step S4400.

In Step S4400, extended imaging operations may be maintained due to the unique benefits provided by the unique structure of the reimaging surface according to this disclosure. Operation of the method proceeds to Step S4500, where operation of the method ceases.

The above-described exemplary systems and methods may reference certain conventional components to provide a brief, general description of suitable image forming means by which to carry out variable data lithographic image forming in a system using a unique imaging member surface. No particular limitation to a specific configuration of the imaging surface is to be construed based on the description of the exemplary elements as depicted and described.

Those skilled in the art will appreciate that other embodiments of the disclosed subject matter may be practiced with many types of image forming elements common to lithographic systems in many different configurations.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 4, and the accompanying description, except where a particular method step is a necessary precondition to execution of any other method step. Individual method steps may be carried out in sequence or in parallel in simultaneous or near simultaneous timing.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. An imaging member in a digital lithographic image forming device, comprising:

a structural member layer; at least one reimageable imaging surface layer, the at least one reimageable imaging surface layer being semi-permeable; and at least one releasing agent reservoir layer, the at least one releasing agent reservoir layer being sandwiched between the structural member layer and the at least one reimageable imaging surface layer, and being configured to store a releasing agent and to supply the releasing agent to an imaging surface of the at least one reimageable imaging surface layer, the supply of releasing agent on the reimageable surface promoting ink transfer from the reimageable surface to a substrate, and the releasing agent being one of Trifluoropropylmethulcyclotrisiloxane (D3F), and Trifluoropropylmethylcyclotetrasiloxane (D4F).

2. The imaging member of claim 1, wherein the imaging surface of the at least one reimageable imaging surface layer supports variable digital data reimaging for lithographic image transfer to the substrate.

3. The imaging member of claim 2, wherein the releasing agent supports efficiency of ink transfer from the imaging surface of the at least one reimageable imaging surface layer to the substrate in a range of 95% or greater.

4. The imaging member of claim 1, wherein the at least one reimageable imaging surface layer comprises an infrared absorbing layer.

5. The imaging member of claim 1, wherein the at least one reimageable imaging surface layer contains an amount of releasing agent in a range of less than 20 percent, and the at least one releasing agent reservoir layer containing an amount of releasing agent in a range of 20 percent to 75 percent.

6. The imaging member of claim 1, wherein each of the at least one reimageable imaging surface layer and the at least one releasing agent reservoir layer comprises a polymeric matrix and the releasing agent.

7. The imaging member of claim 6, wherein the polymeric matrix is an elastomer.

8. The imaging member of claim 7, wherein the elastomer is selected from a group consisting of: a silicone, polydimethylsiloxane (PDMS), a fluorosilicone, and an FKM fluoroelastomer.

9. A digital lithographic image forming device for forming lithographic images on substrates, comprising:

an imaging member, comprising:

a structural member layer;

at least one reimageable imaging surface layer, the at least one reimageable imaging surface layer being semi-permeable; and at least one releasing agent reservoir layer, the at least one releasing agent reservoir layer being sandwiched between the structural member layer and the at least one reimageable imaging surface layer, and being configured to store a releasing agent and to supply the releasing agent to an imaging surface of the at least one reimageable imaging surface layer, the supply of releasing agent on the reimageable surface promoting ink transfer from the reimageable surface to a substrate, and the releasing agent being one of Trifluoropropylmethylcyclotrisiloxane (D3F), and Trifluoropropylmethylcyclotetrasiloxane (D4F);

a cleaning device that cleans the imaging surface of the at least one reimageable imaging surface layer;

a dampening device that dampens the imaging surface of the at least one reimageable imaging surface layer with a layer of dampening solution;

a digital data patterning device that forms a digital pattern in the layer of dampening solution on the imaging surface of the at least one reimageable imaging surface layer;

an inking subsystem that applies ink to the digital pattern formed on the imaging surface of the at least one reimageable imaging structure surface layer to produce an inked image; and an impression roller that applies a pressure in a direction of the at least one reimageable imaging surface layer to form a nip between the impression roller and the imaging member.

10. The device of claim 9, wherein the imaging surface of the at least one reimageable imaging surface layer is variably patterned with a different digital image.

11. The device of claim 9, wherein the at least one reimageable imaging surface layer is a thin compliant layer comprising a polymeric matrix and the releasing agent.

12. The device of claim 11, wherein the polymeric matrix is an elastomer selected from a group consisting of: a silicone, polydimethylsiloxane (PDMS), a fluorosilicone, and an FKM fluoroelastomer.

* * * * *